United States Patent [19]

Kayser

[11] 4,356,938

[45] Nov. 2, 1982

[54] CAULKING GUN WITH PRESSURE RELEASE MECHANISM

[76] Inventor: Steven J. Kayser, 212 Walnut St. Southeast, Minneapolis, Minn. 55414

[21] Appl. No.: 195,886

[22] Filed: Oct. 10, 1980

[51] Int. Cl.[3] ..... B67D 5/42

[52] U.S. Cl. ..... 222/327; 222/391; 74/141.5; 74/154

[58] Field of Search ..... 222/326, 327, 391, 472, 222/473; 74/154, 152, 141.5

[56] References Cited

U.S. PATENT DOCUMENTS

| | | | |
|---|---|---|---|
| 2,180,978 | 3/1939 | Crewe . | |
| 2,229,839 | 9/1939 | Crewe . | |
| 2,233,587 | 4/1940 | Crewe . | |
| 2,367,346 | 2/1942 | Good . | |
| 2,367,347 | 2/1942 | Good . | |
| 2,530,359 | 3/1948 | Peterson . | |
| 2,768,768 | 10/1956 | Cornell et al. | 222/327 X |
| 2,889,085 | 7/1955 | Collins . | |
| 4,126,251 | 11/1978 | Subwick . | |

*Primary Examiner*—Charles A. Marmor

*Attorney, Agent, or Firm*—Kinney, Lange, Braddock, Westman and Fairbairn

[57] ABSTRACT

A pressure release mechanism relieves pressure to a prescribed value in a caulking gun. The pressure release mechanism includes a slot positioned in the handle of the gun and a pin which slides in the slot. A pawl is pivotably attached to the pin and engages the teeth of a ratchet bar to rearward movement of the ratchet bar and piston. An outwardly biased operating lever with an upper cam shaped surface engages the pin and urges the pin and pawl towards the front end of the slot as caulking compound is extruded from the gun under pressure. When the operating lever is completely released, the cam surface permits a biasing spring to move the pawl and pin to the rear of the slot. The pawl is engaged with a ratchet bar tooth as it moves to the rear, and thereby allows the ratchet bar and piston to move rearwardly a limited distance, which relieves the pressure within the caulking gun sufficiently to stop the flow of caulking material.

8 Claims, 6 Drawing Figures

CAULKING GUN WITH PRESSURE RELEASE MECHANISM

BACKGROUND OF THE INVENTION

1. Field of the Invention

The present invention relates to caulking guns, and in particular, relates to caulking guns which have mechanisms for relieving pressure.

2. Description of the Prior Art

Caulking guns extrude caulking compound by use of a piston and ratchet mechanism. When the amount of the caulking compound desired has been discharged from the caulking gun, forward movement of the piston is stopped, and the piston is held in place by the ratchet mechanism which prevents any backward movement. The caulking compound, being elastic, is in a compressive state and continues to flow out of the caulking gun. The continuing flow of compound frequently creates a mess in addition to being a waste of material.

Most caulking guns have some type of pressure release mechanism. To release the pressure in the typical caulking gun, the gun is equipped with a ratchet bar having teeth along one side only, so that the rod may be turned and rotated about its axis. When the rod is turned, the ratchet teeth are no longer held by the ratchet mechanism and the piston is allowed to move freely backward. This method of relieving the pressure in the caulking gun requires the use of two hands, one to hold the gun, and one to turn the ratchet bar. In most instances, the flow of compound from the caulking gun is not stopped immediately by this method sine time is needed to reach and turn the ratchet bar.

In the prior art there are several patents which provide for pressure relief in the caulking gun without having to turn the ratchet bar. They are:

| | |
|---|---|
| Good | U.S. Pat. No. 2,367,347 |
| Peterson | 2,530,359 |
| Collins | 2,889,085 |
| Subwick | 4,126,251 |

In all of these patents, the pressure relief mechanism is not activated automatically, but requires some action by the operator.

There are also several patents in the prior art which show mechanisms that relieve pressure in the caulking gun without requiring any affirmative action by the operator. These patents are:

| | |
|---|---|
| Crewe | U.S. Pat. No. 2,180,978 |
| Crewe | 2,229,839 |
| Crewe | 2,233,587 |
| Good | 2,367,346 |

All of the prior art patents mentioned immediately above fully relieve the pressure in the caulking gun when the operator releases his grip on the lever, except the Crewe U.S. Pat. No. 2,233,587 which relieves the pressure in the caulking gun when the lever is fully squeezed. Fully relieving the pressure automatically in a caulking gun results in having to reestablish sufficient pressure to force the caulk out of gun. Thus, the operator will have to squeeze the operating lever many more times to discharge a desired amount of caulk.

SUMMARY OF THE INVENTION

A pressure relief mechanism for use with a caulking gun relieves pressure within the gun to a prescribed value. The caulking gun has an open tube for holding a caulking tube type cartridge with a discharge end having a nozzle, and a ratchet bar with ratchet teeth rigidly attached to a piston for forcing the caulking material out of the tube. A handle is rigidly attached to the open tube with an operating lever. When the operating lever is squeezed, it urges a first pawl to engage a tooth of the ratchet bar and pushes the bar and piston forward. The forward movement of the piston forces caulking compound out of the cartridge.

The pressure relief mechanism includes a slot positioned proximate an upper end of the handle, and a pin which slides within the slot. A second pawl is pivotally attached to the pin and is biased to engage the teeth of the ratchet bar to prevent rearward movement of the ratchet bar and piston. A cam surface forms the upper portion of the operating lever and rotatably engages the pin. When the operating lever is squeezed, which forces the ratchet bar and piston forward to push caulking out of the cartridge, the pin with the second pawl is urged to a front end of the slot by the cam surface. When the operating lever is completely released, the cam surface permits a biasing spring to pull the pin with the second pawl to a rear end of the slot. Since the second pawl is engaged with a ratchet bar tooth while it moves rearwardly, it permits the ratchet bar and piston to move rearwardly a limited distance to relieve the pressure in the cartridge sufficiently to stop the flow of caulking compound out of the nozzle.

DETAILED DESCRIPTION OF THE PREFERRED EMBODIMENTS

Figure 1:
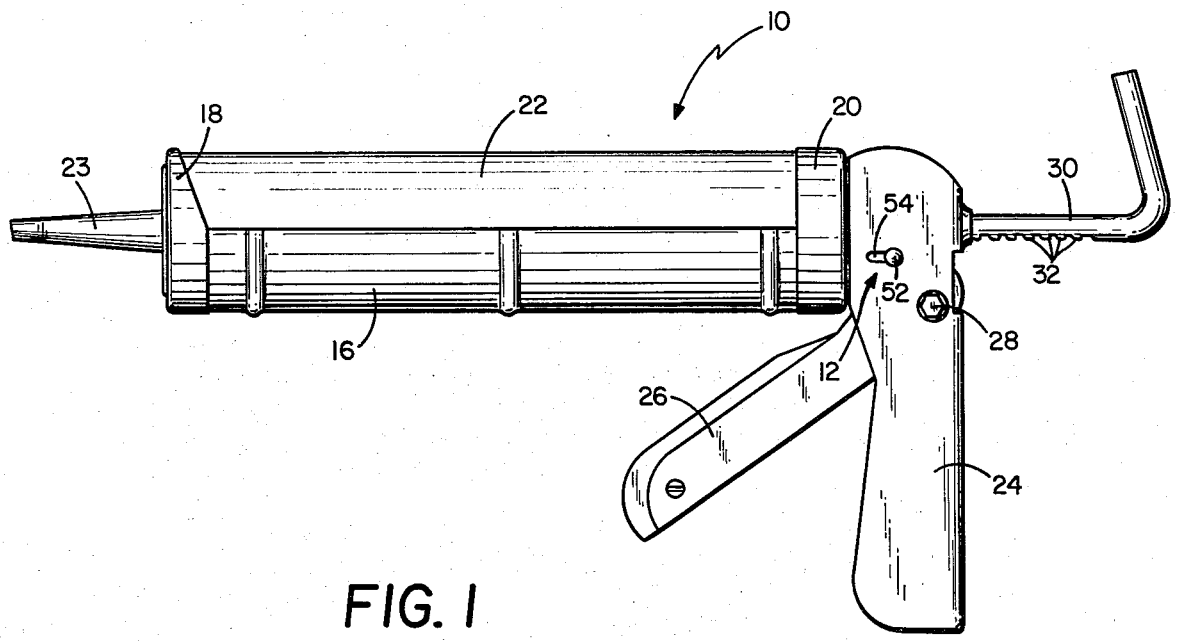
FIG. 1 is a side view of a caulking gun with the pressure relief mechanism of the present invention.
Figure 2:
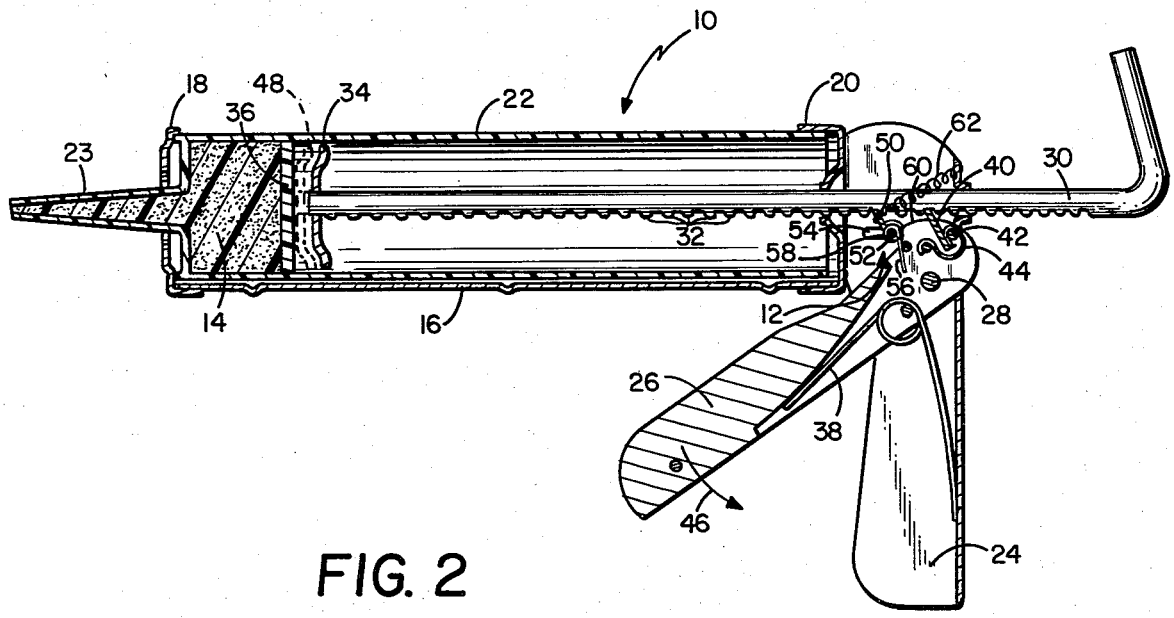
FIG. 2 is a cross-sectional side view of the caulking gun with the pressure relief mechanism with some portions shown whole for purposes of clarity.

Caulking gun 10 having pressure relief mechanism 12 of the present invention is illustrated in FIGS. 1 and 2. Pressure relief mechanism 12 relieves the pressure within caulking gun 10 sufficiently to stop the flow of caulking material 14. Caulking gun 10 preferably includes open tube 16 with cup ends 18 and 20 rigidly attached to both ends of open tube 16. A conventional caulking cartridge 22 with nozzle 23 containing caulking material 14 is securely held in place by open tube 16 and cup ends 18 and 20. Handle 24 is rigidly attached to cup end 20. Operating lever 26 is pivotally attached to handle 24 at an upper end preferably by bolt 28. Ratchet bar 30 having teeth 32 along one longitudinal side is coaxially and rigidly attached to piston 34. Piston 34 coaxially engages movable backstop 36 of cartridge 32.

Operating lever 26 is biased outwardly preferably by torsion spring 38. Operating lever 26 has first pawl 40 pivotally attached to lever 26, preferably by pin 42. Pawl 40 is biased by spring 44 to ensure engagement of teeth 32 of ratchet bar 30. Operating lever 26 is squeezed toward handle 24 as indicated by arrow 46, pivoting about bolt 28 with pawl 40 pushing ratchet bar 30 and piston 34 forwardly, as indicated by broken lines 48.

Second pawl 50 is pivotally attached to pin 52 which slides within slot 54. Slot 54 is substantially parallel to the ratchet bar 30 and projects through both sides of the handle. Slot 54 is of sufficient length to relieve pressure in the caulking material 14 to a limited extent. Pawl 50 is biased by spring 56 to ensure engagement with teeth 32. Pin 52 has rotatably attached rollers 58 preferably on both sides of spring 56 which engage cam surface 60. Cam surface 60 forms an upper portion of operating lever 26. Bias spring 62 attached to second pawl 50 at one end and to the handle 24 at another end biases second pawl 50 and pin 52 toward the rear of slot 54.

Figure 3:
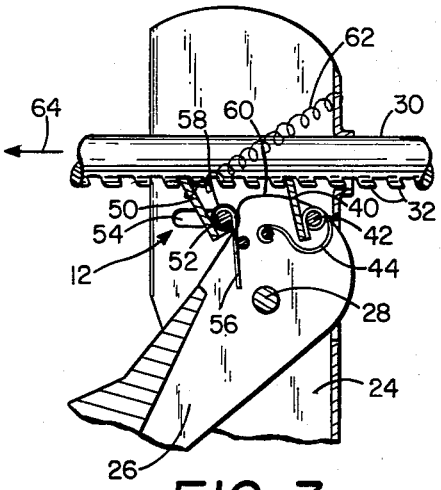
FIG. 3 is an enlarged fragmentary view of the pressure relief mechanism in a start position.

Pressure relief mechanism 12 is illustrated through one operational cycle in FIGS. 3–7. The start of the operational cycle is illustrated in FIG. 3. Operating lever 26 and handle 24 are in a "release" position being biased from each other by spring 38, shown in FIG. 2. Pin 52 and second pawl 50 have been biased to the rear end of slot 54 by coil spring 62. Cam surface 60 of operating lever 26 does not interfere with the rearwardly biased position of pin 52 and second pawl 50 at this stage. First pawl 40 is in a start position engaging a tooth 32 of ratchet bar 30 to drive ratchet bar 30 forward in a direction of arrow 64 for extrusion of caulking material 14 out of cartridge 22.

Figure 4:
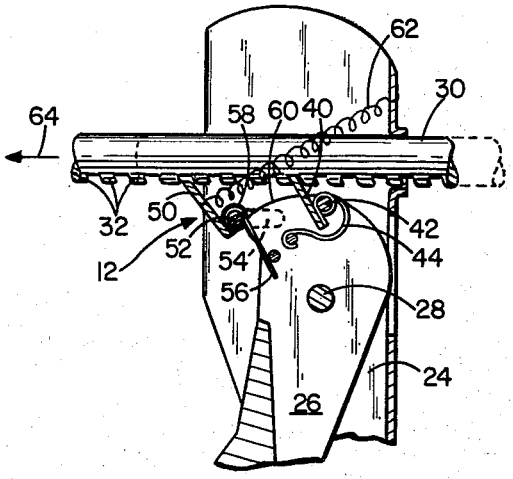
FIG. 4 is an enlarged fragmentary view of the pressure relief mechanism with the ratchet bar in a forward motion.

FIG. 4 shows the next operational stage wherein caulking material 14 is being extruded. Operating lever 26 is squeezed toward handle 24. This results in operating lever 26 pivoting about bolt 28 with first pawl 40 pushing against tooth 32 of ratchet bar 30, thereby extruding material 14 from caulking gun 10. During this stage, pin 52 and second pawl 50 are being urged to the front end of slot 54 by cam surface 60 overcoming the biasing force of coil spring 62. In order to urge pin 52 and second pawl 50 forward, the radial distance of cam surface 60 from pivot bolt 28 to the surface of cam 60 touching rollers 58 is increased; that is, the radial distance increase from the "release" position as the operating lever pivots about bolt 28. At this stage, second pawl 50 does not interfere with the forward movement of ratchet bar 30 as indicated by arrow 64, since second pawl 50 is inclined in the direction of travel of ratchet bar 30.

Figure 5:
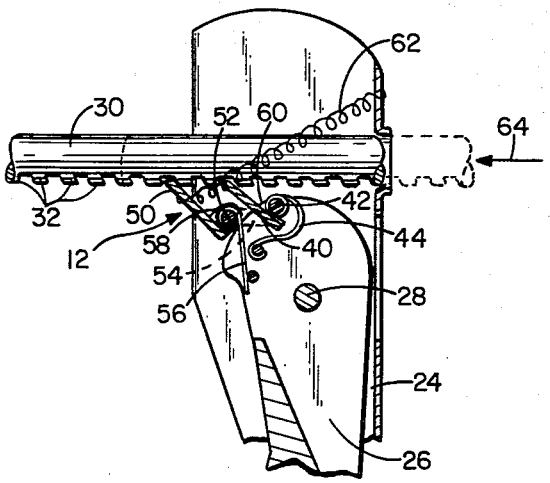
FIG. 5 is an enlarged fragmentary view of the pressure relief mechanism with the ratchet bar, both pawls, and pin at their forwardmost positions.

When operating lever 26 and handle 24 have been squeezed together, as shown in FIG. 5, ratchet bar 30 has moved to its forwardmost position for the present operational cycle. During this stage, pin 52 and second pawl 50 are held at the forward end of slot 54 by cam surface 60. The radial distance from bolt 28 to the cam surface 60 touching the rollers 58 is sufficient to force pin 52 against the front end of slot 54. Caulking material 14, even though forward movement of ratchet bar 30 and piston 34 has stopped, is still under pressure and being extruded.

Figure 6:
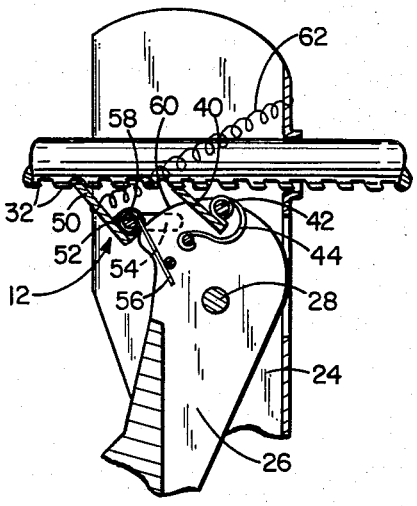
FIG. 6 is an enlarged fragmentary view of the pressure relief mechanism with the ratchet bar, second pawl and pin moving rearwardly to relieve pressure.

When operating lever 26 is released, biasing spring 38 pushes lever 26 and handle 24 apart, as shown in FIG. 6. First pawl 40 disengages from teeth 32 and skips over teeth 32 as operating lever 26 pivots about bolt 28 and away from handle 24. Second pawl 50 engages tooth 32 to prevent ratchet bar 30 from moving rearward. The operating lever 26 thus is squeezed and released repeatedly to extrude caulking material on a continual basis, as illustrated in FIGS. 5 and 6. The radial distance of cam surface 60 from bolt 28 to rollers 58 stays substantially the same during extrusion keeping the pin 52 and second pawl 50 at the front end of slot 54.

The end of the operational cycle with the operating lever 26 completely released and biased from handle 24 is illustrated in FIG. 3. Pin 52 and second pawl 50 are at the rear of slot 54 and have relieved caulking material 14 of sufficient pressure to stop extrusion and hold ratchet bar 30 from further rearward movement. Cam surface 60 engages rollers 58 at a point on cam surface 60 that has a substantially decreased radial distance to bolt 28. Engagement at this point permits coil spring 62 to bias pawl 50 and pin 52 to the rear end of the slot 54. At this stage, caulking gun 10 is ready to begin another operational cycle, still having caulking material 14 under sufficient pressure to resume extrusion of caulking material 14 upon squeezing lever 26.

CONCLUSION

The present invention provides a pressure relief mechanism which relieves pressure automatically and sufficiently to stop extrusion of the caulking material. The pressure relief mechanism maintains the caulking material under sufficient pressure to resume extrusion.

Although the present invention has been described with reference to the preferred embodiments, persons skilled in the art will recognize that changes may be made in form and detail without departing from the spirit and scope of the invention.

What is claimed is:

1. A pressure relief mechanism for use with a caulking gun having a ratchet bar with ratchet teeth, the bar being attached to a piston for extruding an elastic fluid, a handle with an operating lever pivotally attached at a point proximate upper ends of the handle and the operating lever, means for biasing lower ends of the handle and the operating lever away from one another, and first pawl means pivotally attached to the operating lever proximate the upper end of the operating lever and biased to engage the teeth of the ratchet bar for forward movement of the ratchet bar and piston as the lower end of the operating lever is squeezed toward the handle, the pressure relief mechanism comprising:

slot means proximate the upper end of the handle, the slot means being generally parallel to the ratchet bar proximate the upper end of the handle and having a front end and a rear end;

a pin slidably engaging the slot means;

second pawl means for engaging the teeth of the ratchet bar to prevent rearward movement of the ratchet bar, the second pawl means being pivotally attached to the pin;

biasing means for biasing the second pawl means toward the rear end of the slot means;

a cam surface on an upper portion of the operating lever, the cam surface having first and second portions of different radius whereby when the operating lever is squeezed toward the handle, the ratchet bar and piston are urged forwardly by the first pawl means placing under pressure and extruding the elastic fluid with the second pawl means and pin being urged by the first portion of the cam surface to the front end of the slot means, and when the operating lever is released, the second portion of the cam surface permits the biasing means to bias the second pawl means to the rear of the slot means permitting the ratchet bar to move rearwardly a limited distance, relieving pressure sufficiently to stop extrusion of the elastic fluid.

2. The mechanism of claim 1 wherein the pin has roller means rotatably attached for engaging the cam surface.

3. The mechanism of claim 1 wherein the first portion of the cam surface has a sufficient radial distance from the point of pivotal attachment of the operating lever and the handle to hold the pin at the front end of the slot means, and wherein the second portion of the cam surface has a sufficiently decreased radial distance from the point of pivotal attachment of the operating lever and the handle to permit the pin to be biased to the rear of the slot means.

4. The mechanism of claim 1 wherein the slot means is of sufficient length to permit second pawl means to move sufficiently rearwardly to relieve enough pressure to stop extrusion of the elastic fluid and still maintain the elastic fluid under adequate pressure to smoothly restart extrusion.

5. A caulking gun comprising:

an open tube;

a piston for extruding an elastic fluid;

a ratchet bar means with ratchet teeth, the ratchet bar means being attached to the piston and extending through one end of the open tube;

a handle with an upper and a lower end fixedly attached to the end of the open tube having the ratchet bar extending therethrough;

an operating lever with an upper and a lower end pivotally attached at a point proximate the upper ends of the handle and the operating lever;

first biasing means for biasing the lower ends of the handle and operating lever from each other;

first pawl means for engaging the teeth of the ratchet bar means for forward movement of the ratchet bar means and the piston for extruding the elastic fluid, the first pawl means being pivotally attached proximate the upper end of the operating lever and being biased to engage the teeth of the ratchet bar means;

pin means;

slot means for slidably engaging the pin means positioned proximate the upper end of the handle, the slot means having a front and rear end and being generally parallel to the ratchet bar means proximate the upper end of the handle;

second pawl means for engaging the teeth of the ratchet bar means to prevent rearward movement of the ratchet bar, the second pawl means being pivotally attached to the pin;

biasing means for biasing the second pawl means toward the rear end of the slot means; and a cam surface on the upper end of the operating lever, the cam surface having a first portion and a second portion with the first portion having a greater radial distance from the point of pivotal attachment of the handle and operating lever than the second portion with the radial distance being substantially constant during extrusion thereby keeping the pin means and the second pawl means proximate the front end of the slot means during extrusion of the elastic fluid, and the second portion beginning at a point on the cam surface that engages the pin means when the operating lever is completely released, the second portion permitting the second biasing means to bias the pin means and second pawl means proximate the rear end of the slot means permitting the ratchet bar means to move rearwardly a limited distance.

6. The mechanism of claim 5 wherein the pin has a roller means attached for engaging the cam surface.

7. The mechanism of claim 5 wherein the first portion of the cam surface has a sufficient radial distance from the point of pivotal attachment of the operating lever and the handle to hold the pin at the front end of the slot means, and wherein the second portion of the cam surface has a sufficiently decreased radial distance from the point of pivotal attachment of the operating lever and the handle to permit the pin to be biased to the rear of the slot means thereby relieving the pressure sufficiently to stop extrusion of the elastic fluid.

8. The mechanism of claim 5 wherein the slot means is of sufficient length to permit second pawl means to move sufficiently rearwardly to relieve enough pressure to stop extrusion of the elastic fluid and still maintain the elastic fluid under adequate pressure to smoothly restart extrusion.

* * * * *